US011657763B2

(12) United States Patent
Kim et al.

(10) Patent No.: US 11,657,763 B2
(45) Date of Patent: May 23, 2023

(54) DISPLAY DEVICE AND METHOD OF DRIVING THE SAME

(71) Applicant: LG Display Co., Ltd., Seoul (KR)

(72) Inventors: Dong Ju Kim, Paju-si (KR); Soon Dong Cho, Gumi-si (KR); Jun O Hur, Daegu (KR); Dong Won Park, Goyang-si (KR); Won Yong Jang, Bucheon-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/491,346

(22) Filed: Sep. 30, 2021

(65) Prior Publication Data

US 2022/0108659 A1 Apr. 7, 2022

(30) Foreign Application Priority Data

Oct. 5, 2020 (KR) ..... 10-2020-0127925

(51) Int. Cl.

| | |
|---|---|
| ***G09G 3/00*** | (2006.01) |
| ***G09G 3/3266*** | (2016.01) |
| ***G09G 3/36*** | (2006.01) |

(52) U.S. Cl.

CPC ..... *G09G 3/3266* (2013.01); *G09G 3/3674* (2013.01); *G09G 2310/0286* (2013.01); *G09G 2310/0289* (2013.01)

(58) Field of Classification Search

CPC ..... G09G 3/3266; G09G 2310/08; G09G 2310/0286; G09G 2300/0426; G09G 3/3233; G09G 3/3677; G09G 2330/021; G09G 2300/0861

See application file for complete search history.

(56) References Cited

U.S. PATENT DOCUMENTS

| | | | | |
|---|---|---|---|---|
| 7,663,593 | B2 | 2/2010 | Jinta | |
| 2006/0197554 | A1 | 9/2006 | Jinta | |
| 2017/0011691 | A1* | 1/2017 | Mamba | G09G 3/3696 |
| 2017/0278451 | A1* | 9/2017 | Peng | G09G 3/3677 |
| 2019/0295451 | A1* | 9/2019 | Wen | G09G 3/20 |

FOREIGN PATENT DOCUMENTS

| | | | |
|---|---|---|---|
| KR | 10-2006-0096297 | A | 9/2006 |
| KR | 10-1390315 | B1 | 4/2014 |
| KR | 10-2017-0038390 | A | 4/2017 |
| KR | 10-1813713 | B1 | 12/2017 |
| KR | 10-2009892 | B1 | 8/2019 |

* cited by examiner

*Primary Examiner* — Michael A Faragalla
(74) *Attorney, Agent, or Firm* — Fenwick & West LLP

(57) ABSTRACT

A display device includes a display panel displaying an image, a scan driver configured to apply scan signals to the display panel, and a power supply configured to apply a gate high voltage and a gate low voltage to the scan driver. The scan driver discharges the display panel based on a second gate high voltage lower than the gate high voltage during a discharging operation of the display panel.

10 Claims, 18 Drawing Sheets

DISPLAY DEVICE AND METHOD OF DRIVING THE SAME

CROSS-REFERENCE TO RELATED APPLICATIONS

This application claims the benefit of Korean Patent Application No. 10-2020-0127925, filed on Oct. 5, 2020, which is hereby incorporated by reference as if fully set forth herein.

BACKGROUND OF THE INVENTION

Field of the Invention

The present invention relates to a display device and a method of driving the same.

Discussion of the Related Art

The development of information technology has brought the growth of the market for display devices, which are a connection medium between users and information. Accordingly, display devices such as a light emitting display (LED) device, a quantum dot display (QDD) device, and a liquid crystal display (LCD) device are increasingly used.

Such a display device includes a display panel including sub-pixels, a driver that outputs a driving signal for driving the display panel, and a power supply that generates power to be supplied to the display panel or the driver.

In the display device, when driving signals such as scan signals and data signals are applied to sub-pixels formed on the display panel, the selected sub-pixel transmit light or emit light directly, thereby displaying an image.

SUMMARY OF THE INVENTION

Accordingly, the present invention is directed to a display device and a method of driving the same that substantially obviate one or more problems due to limitations and disadvantages of the related art.

The present invention is intended to improve the driving stability and reliability of a display device by reducing the possibility of occurrence of inrush current and preventing inrush current-caused damage or burnt at a vulnerable part through reduction of a peak current during discharging of a display panel.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a display device includes a display panel displaying an image, a scan driver configured to apply scan signals to the display panel, and a power supply configured to apply a gate high voltage and a gate low voltage to the scan driver. The scan driver discharges the display panel based on a second gate high voltage lower than the gate high voltage during a discharging operation of the display panel.

When the power supply is powered off, the display panel may be discharged based on the second gate high voltage after a delay time.

The scan driver may include a logic controller configured to monitor the gate high voltage and a gate all high signal for simultaneously switching the states of the scan signals and, when the gate high voltage is dropped to an internally set voltage level, control output of the gate high voltage based on a discharge enable signal that enables discharging of the display panel.

The logic controller may include a voltage monitor, and the voltage monitor may include a first monitoring resistor having one end connected to a gate high voltage line through which the gate high voltage is transmitted, a second monitoring resistor having one end connected to the other end of the first monitoring resistor and the other end connected to a ground line, a first comparator having an inverting terminal connected between the other end of the first monitoring resistor and the one end of the second monitoring resistor, and a non-inverting terminal connected to a first reference voltage line, an inverter having an input terminal connected to an all high signal line through which the gate all high signal is transmitted, and an AND gate having a first input terminal connected to an output terminal of the inverter, a second input terminal connected to an output terminal of the first comparator, and an output terminal connected to an input terminal of a discharge controller configured to output the discharging enable signal.

The scan driver may include a voltage controller configured to output the second gate high voltage during the discharging operation of the display panel, and a logic controller configured to control the voltage controller.

The voltage controller may include a gate high voltage converter configured to convert the gate high voltage to the second gate high voltage, and a switch configured to output or not output the second gate high voltage of the gate high voltage converter in response to a switch control signal received from the logic controller.

The power supply may include a gate voltage converter configured to, convert the gate high voltage to the second gate high voltage, when an input voltage is dropped to an internally set voltage level.

The power supply may further include a voltage detector configured to detect the input voltage. The voltage detector may include a first resistor having one end connected to a first input terminal to which the input voltage is applied, a second resistor having one end connected to the other end of the first resistor and the other end connected to a ground line, and a second comparator having an inverting terminal connected between the first resistor and the second resistor, a non-inverting terminal connected to a second reference voltage line, and an output terminal connected to an input terminal of the gate voltage converter.

The scan driver may be configured to simultaneously output scan signals turning on thin film transistors of the display panel based on the second gate high voltage during the discharging operation of the display panel.

In another aspect of the present invention, a method of driving a display device includes powering off a display panel, converting a gate high voltage to be applied to the display panel to a second gate high voltage lower than the gate high voltage, and discharging the display panel based on the second gate high voltage.

The conversion may include converting the gate high voltage to the second gate high voltage when an input voltage for driving the display panel is dropped to a set voltage level.

The discharging may include turning on thin film transistors of the display panel by simultaneously outputting scan signals based on the second gate high voltage.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

A display device according to the present invention may be implemented as, but not limited to, a television, a video player, a personal computer (PC), a home theater, a vehicle electric device, a smartphone, or the like. The display device according to the present invention may be implemented as a light emitting display (LED) device, a quantum dot display (QDD) device, a liquid crystal display (LCD) device, or the like. However, the following description is given in the context of a light emitting display device that directly emits light based on inorganic LEDs or organic LEDs as an example, for convenience of description.

Figure 1:
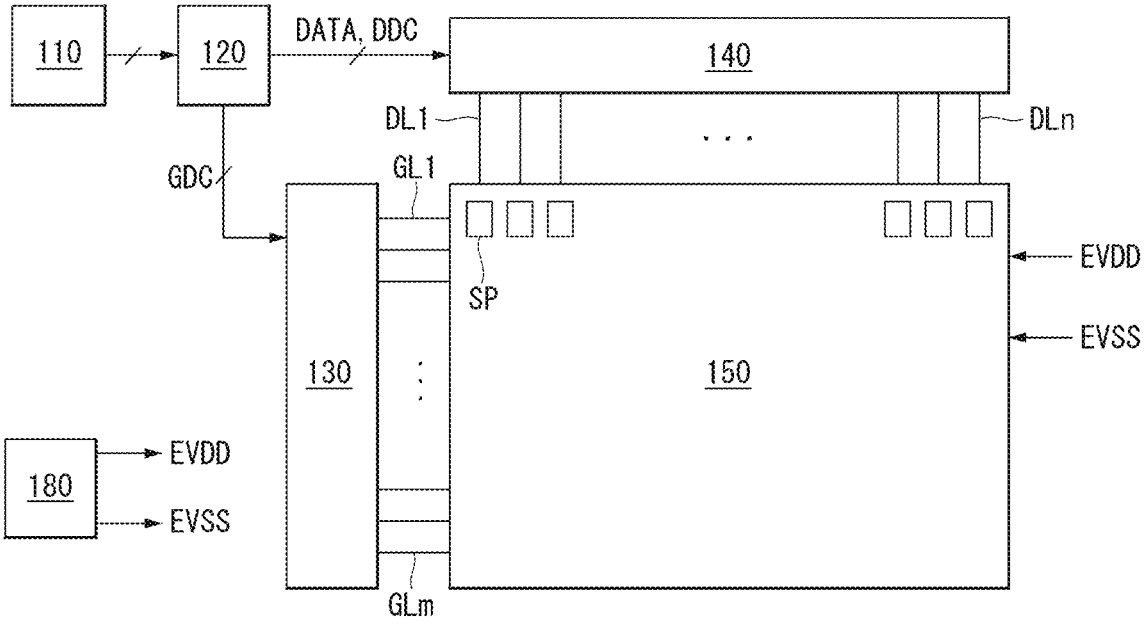
FIG. 1 is a block diagram illustrating a light emitting display device according to a first embodiment of the present invention.
Figure 2:
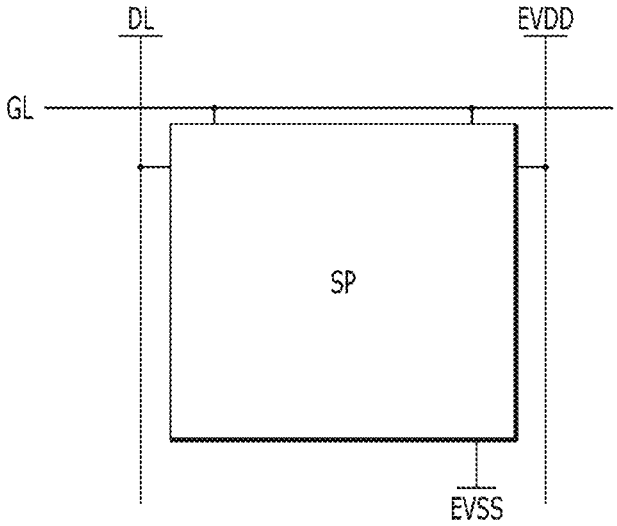
FIG. 2 is a diagram illustrating a sub-pixel (SP) illustrated in FIG. 1.

FIG. 1 is a block diagram illustrating a light emitting display device according to a first embodiment of the present invention, and FIG. 2 is a diagram illustrating the configuration of a sub-pixel illustrated in FIG. 1.

Referring to FIGS. 1 and 2, the light emitting display device according to the first embodiment of the present invention may include an image supply 110, a timing controller 120, a scan driver 130, a data driver 140, a display panel 150, and a power supply 180.

The image supply (or host system) 110 may output various driving signals together with an image data signal received from the outside or an image data signal stored in an internal memory. The image supply 110 may transmit the data signals and the various driving signals to the timing controller 120.

The timing controller 120 may output a gate timing control signal GDC for controlling the operation timing of the scan driver 130, a data timing control signal DDC for controlling the operation timing of the data driver 140, and various synchronization signals (a vertical synchronization signal Vsync and a horizontal synchronization signal Hsync). The timing controller 120 may transmit a data signal DATA received from the image supply 110 together with the data timing control signal DDC to the data driver 140. The timing controller 120 may be configured in the form of an integrated circuit (IC) and mounted on a printed circuit board (PCB), which should not be construed as limiting the present invention.

The scan driver 130 may output a scan signal (or a scan voltage) in response to the gate timing control signal GDC received from the timing controller 120. The scan driver 130 may transmit the scan signal to sub-pixels included in the display panel 150 through scan lines GL1 to GLm. The scan driver 130 may be configured in the form of an IC or may be formed directly on the display panel 150 in a gate-in-panel (GIP) manner, which should not be construed as limiting the present invention.

The data driver 140 may sample and latch the data signal DATA in response to the data timing control signal DDC received from the timing controller 120, and convert the digital data signal to an analog data voltage based on a gamma reference voltage. The data driver 140 may supply the data voltage to the sub-pixels included in the display panel 150 through data lines DL1 to DLn. The data driver 140 may be configured in the form of an IC and mounted on the display panel 150 or may be mounted on the PCB, which should not be construed as limiting the present invention.

The power supply 180 may generate high-potential first power and low-potential second power based on an external input voltage received from the outside and output the high-potential first power and the low-potential second power through a first power line EVDD and a second power line EVSS. The power supply 180 may generate and output a voltage (e.g., a gate voltage including a gate high voltage and a gate low voltage) required for driving the scan driver 130 or a voltage (e.g., a drain voltage including a drain voltage and a half drain voltage) required for driving the data driver 140.

The display panel 150 may display an image in response to a driving signal including the scan signal and the data voltage, the first power, and the second power. The sub-pixels of the display panel 150 directly emit light. The display panel 150 may be manufactured based on a rigid or flexible substrate formed of a material such as glass, silicon, or polyimide. In addition, the sub-pixels that emit light may be red, green, and blue (RGB) sub-pixels or red, green, blue, and white (RGBW) sub-pixels, which form pixels.

For example, one sub-pixel SP may include a pixel circuit with a switching transistor, a driving transistor, a storage capacitor, and an organic light emitting diode (OLED). The sub-pixels SP used in the light emitting display device, which directly emit light, have a complex circuit configuration. Furthermore, there are various compensation circuits for compensating for deterioration of not only the OLED that emits light but also the driving transistor that applies a driving current to the OLED. In this context, a sub-pixel SP is simply illustrated in the form of a block.

The timing controller 120, the scan driver 130, and the data driver 140 have been described above as separate components. However, one or more of the timing controller 120, the scan driver 130, and the data driver 140 may be integrated into one IC depending on implementation of the light emitting display device.

Figure 3A:
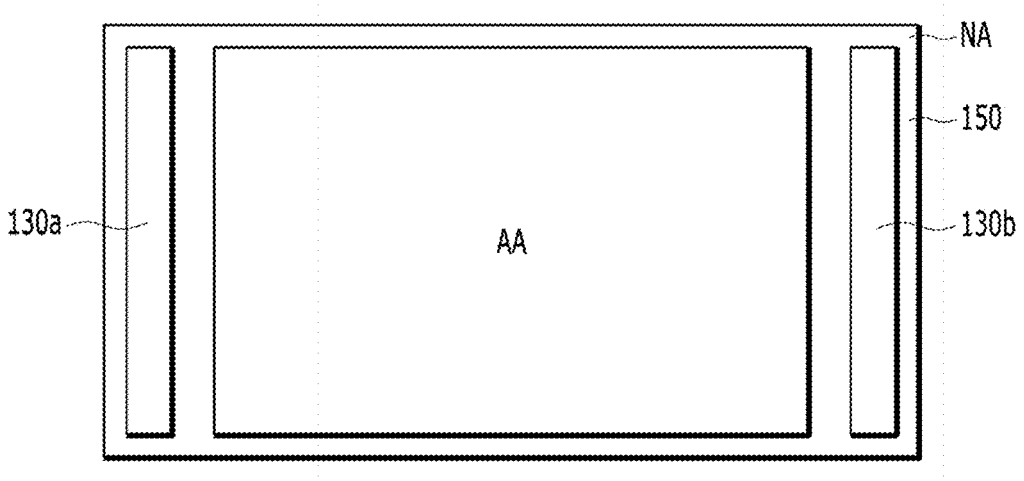
FIGS. 3A and 3B are diagrams illustrating exemplary layouts of a gate-in-panel (GIP) scan driver.
Figure 3B:
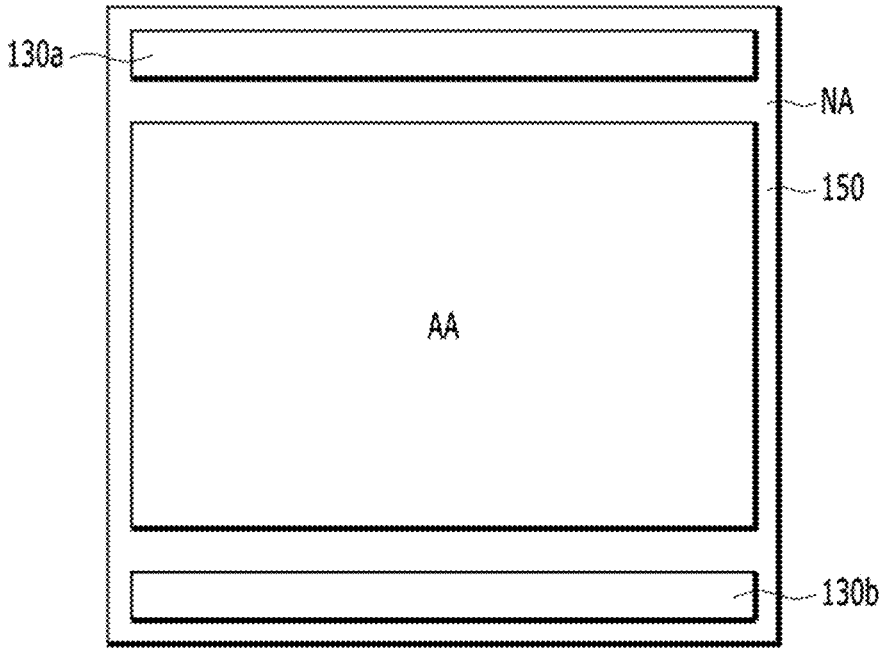
Figure 4:
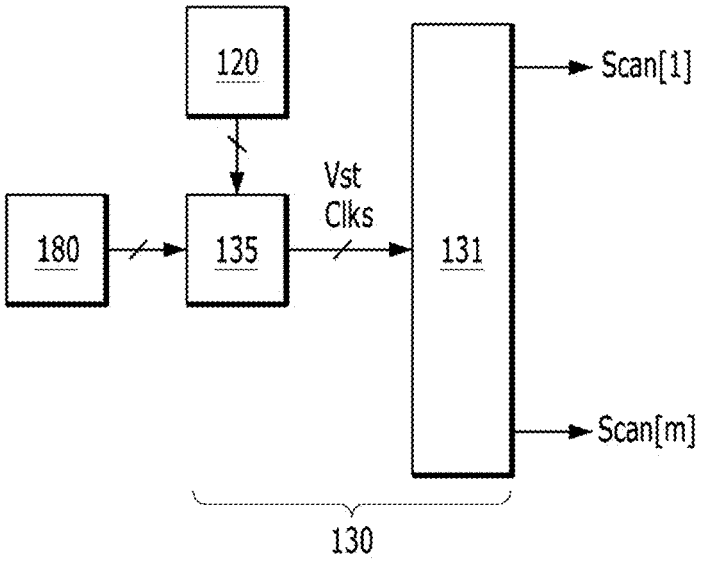
FIGS. 4 and 5 are diagrams illustrating the configurations of devices related to the GIP scan driver.
Figure 5:
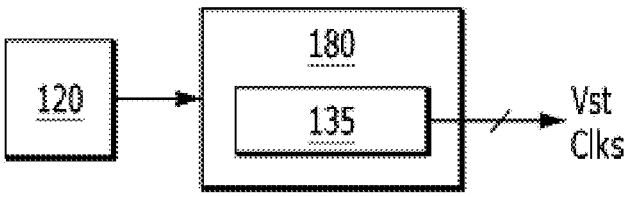

FIGS. 3A and 3B are diagrams illustrating exemplary layouts of a GIP scan driver, and FIGS. 4 and 5 are diagrams illustrating the configurations of devices related to the GIP scan driver.

Referring to FIGS. 3A and 3B, GIP scan driver 130*a* and 130*b* are arranged in a non-display area NA of the display panel 150. As illustrated in FIG. 3A, the scan drivers 130*a* and 130*b* may be disposed in left and right non-display areas NA of the display panel 150. As illustrated in FIG. 3B, the scan drivers 130*a* and 130*b* may be disposed in upper and lower non-display areas NA of the display panel 150.

While the scan drivers 130*a* and 130*b* are described and illustrated as disposed in the non-display areas NA to the left and right of a display area AA or above and below the display area AA, by way of example, the scan drivers 130*a* and 130*b* may be disposed only on the left, right, upper or lower side of the display area AA.

Referring to FIG. 4, the GIP scan driver 130 may include a shift register 131 and a level shifter 135. The level shifter 135 may generate clock signals Clks and a start signal Vst based on signals and voltages received from the timing controller 120 and the power supply 180. The clock signals Clks may be generated with K different phases (K is an integer equal to or greater than 2) such as 2 phases, 4 phases, or 8 phases.

The shift register 131 may operate based on the signals Clks and Vst received from the level shifter 135 and output scan signals Scan[1] to Scan[m] to turn on or off transistors formed on the display panel. The shift register 131 may be formed in the form of a thin film on the display panel in the GIP manner. Accordingly, a part of the scan driver 130 formed on the display panel may be the shift register 131. The scan drivers 130*a* and 130*b* in FIGS. 3A and 3B may correspond to the shift register 131.

Referring to FIGS. 4 and 5, unlike the shift register 131, the level shifter 135 may be independently formed as an IC or included in the power supply 180. However, this is merely exemplary, to which the present invention is not limited.

Figure 6:
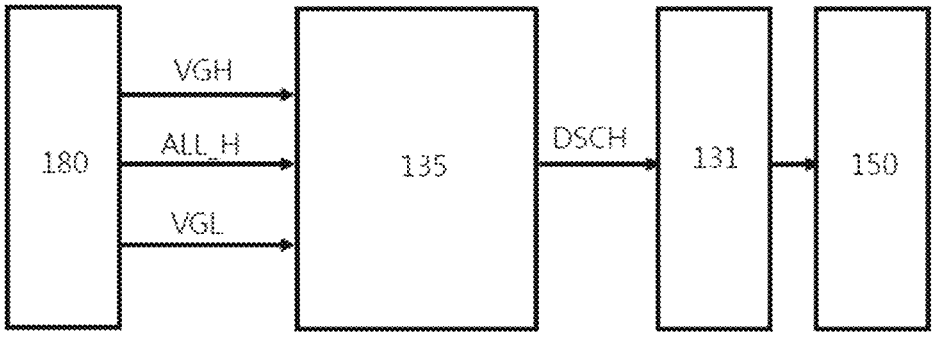
FIG. 6 is a diagram illustrating a circuit part for discharging a display panel in the light emitting display device according to the first embodiment of the present invention.
Figure 7:
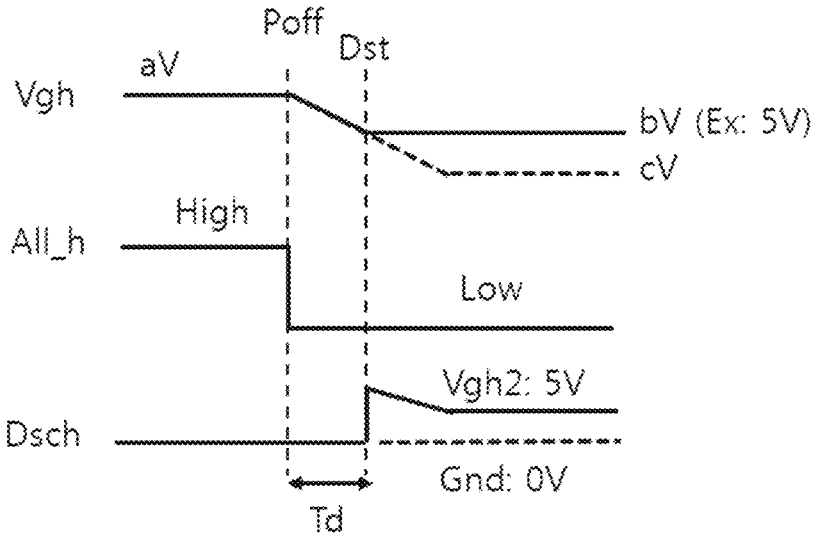
FIG. 7 is a diagram illustrating the waveforms of signals and voltages in circuits illustrated in FIG. 6.
Figure 8:
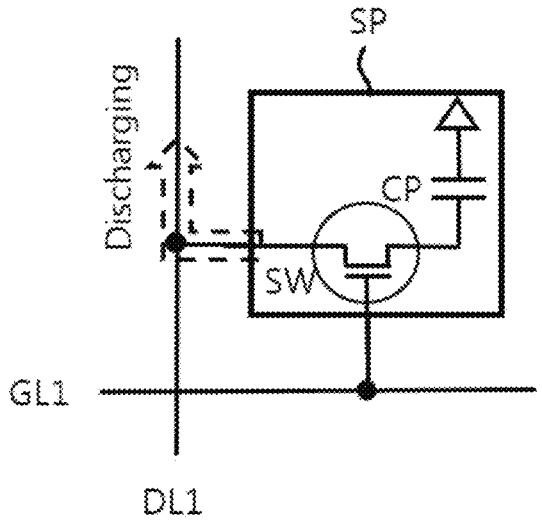
FIG. 8 is a diagram illustrating an operation of discharging a sub-pixel according to the signals and voltages illustrated in FIG. 7.

FIG. 6 is a diagram illustrating a circuit part for discharging the display panel in the light emitting display device according to the first embodiment of the present invention, FIG. 7 is a diagram illustrating the waveforms of signals and voltages in the circuits illustrated in FIG. 6, and FIG. 8 is a diagram illustrating an operation of discharging a sub-pixel according to the signals and voltages illustrated in FIG. 7.

Referring to FIG. 6, the power supply 180 may output a gate high voltage through a gate high voltage line VGH, a gate low voltage through a gate low voltage line VGL, and a gate all high signal through an all high line ALL_H. The gate all high signal may serve to simultaneously switch the scan signals to logic high.

The level shifter 135 may output a discharge signal that discharges the display panel 150 through a discharge signal line DSCH in correspondence with the logic state of the gate all high signal received from the power supply 180 through the all high line ALL_H. The shift register 131 may discharge the display panel 150 based on the discharge signal received from the level shifter 135.

Referring to FIGS. 6, 7 and 8, the gate high voltage Vgh output through the gate high voltage line VGH may be maintained to be aV (e.g., 14V) during a power supply period of the power supply 180 (or during a normal driving period of the light emitting display device). However, when the voltage level starts to drop at a power-off time Poff of the power supply 180 and reaches a discharge start period Dst, the voltage level may be maintained to be bV (e.g., 5V) for a certain period of time. After the certain period of time, the voltage level may drop again from bV to cV (e.g., a voltage lower than 5V or a voltage close to or equal to a ground voltage).

The gate all high signal All_h output through the all high line ALL_H may be maintained to be logic high during the power supply period of the power supply 180. However, the gate all high signal All_h may switch to logic low in synchronization with the power-off time Poff of the power supply 180.

During the power supply period of the power supply 180, the discharge signal Dsch output through the discharge signal line DSCH may be maintained at the level of the ground voltage Gnd (0V) or in a non-output state. However, after a delay time Td from the power-off time Poff of the power supply 180, the discharge signal Dsch may be output at the level of a second gate high voltage Vgh2 (5V) lower than the level of the gate high voltage Vgh.

The reason for delaying the discharge signal Dsch by the specific time Td and then outputting the discharge signal Dsch at the level of the second gate high voltage Vgh2 (5V) from the level shifter 135 is that the discharge start period Dst is defined to coincide with the time when the gate high voltage output from the power supply 180 reaches a specific voltage level.

When the discharge signal Dsch is output at the level of the second gate high voltage lower than the level of the gate high voltage output before the power-off, the possibility of occurrence of peak current which may be caused during discharging of the sub-pixels SP included in the display panel may be reduced (a discharge path is provided through the data line DL1 connected to switching transistors SW turned on during the discharging operation). A related description will be given below.

Figure 9:
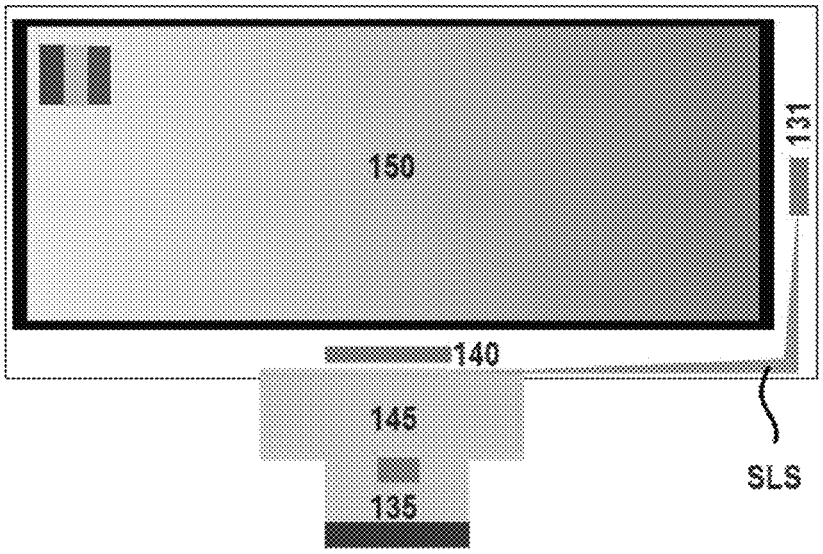
FIG. 9 is a plan view illustrating a partial configuration of a modular light emitting display device.
Figure 10:
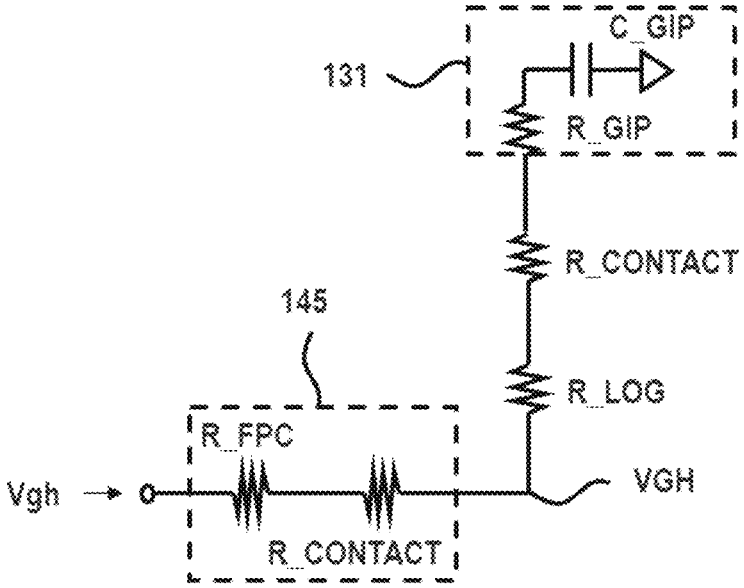
FIG. 10 is a diagram illustrating a resistance component R and a capacitance component C in a gate high voltage line between a level shifter and a shift register.
Figure 11:
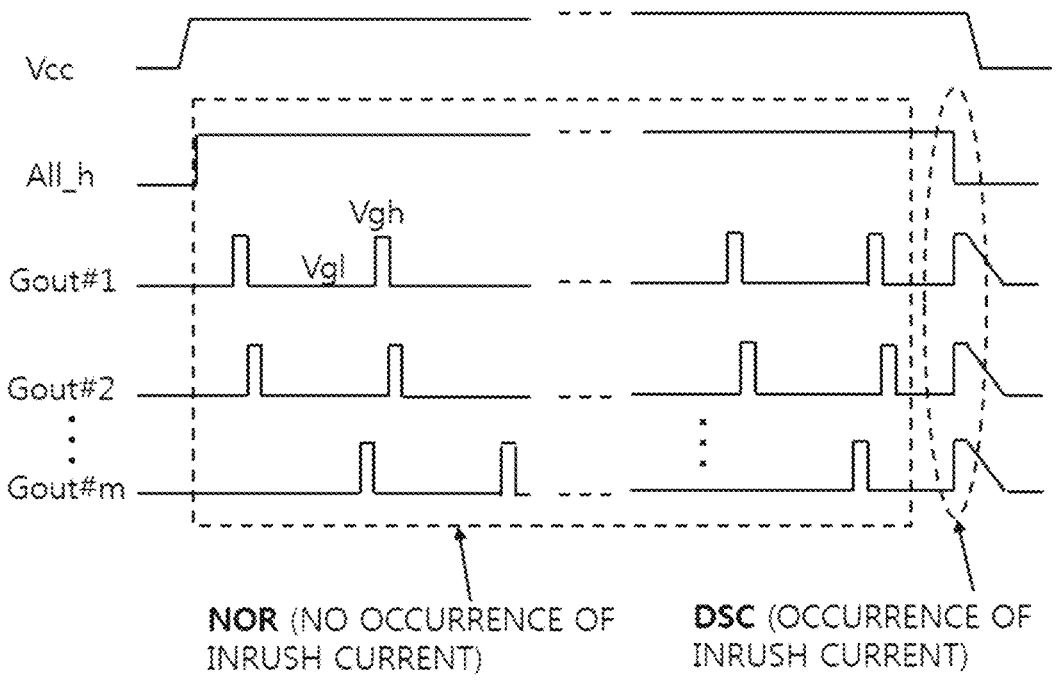
FIG. 11 is a diagram illustrating current changes that may occur during discharging of the display panel.
Figure 12:
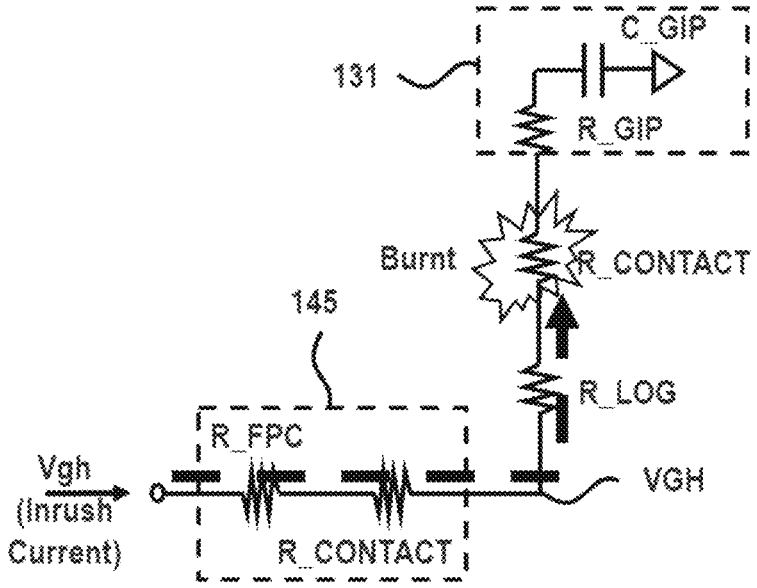
FIG. 12 is a diagram illustrating a problem caused by inrush current that may be generated during discharging of the display panel.

FIG. 9 is a plan view illustrating a partial configuration of a modular light emitting display device, FIG. 10 is a diagram illustrating a resistance component R and a capacitance component C in a gate high voltage line between a level shifter and a shift register, FIG. 11 is a diagram illustrating current changes that may occur during discharging of a display panel, and FIG. 12 is a diagram illustrating a problem caused by inrush current that may be generated during discharging of the display panel.

Referring to FIG. 9, the modular light emitting display device may have such a structure that the data driver 140 and the shift register 131 are disposed around the display panel 150, and the level shifter 135 is disposed on a flexible circuit board 145 connected to the display panel 150. Signal lines SLS for signal transmission as well as electrical connections may be arranged between the level shifter 135 and the shift register 131.

Referring to FIGS. 9 and 10, the gate high voltage line VGH through which the gate high voltage Vgh is transmitted may be located among the signal lines SLS between the level shifter 135 and the shift register 131. The gate high voltage line VGH may include parasitic components R_FPC and R_CONTACT of the flexible circuit board 145, parasitic components R_GIP and C_GIP of the shift register 131, and parasitic components R_LOG and R_CONTACT between the level shifter 135 and the shift register 131. R represents a resistance component, C represents a capacitance component, and CONTACT post fixed to R represents contact resistance.

Referring to FIGS. 11 and 12, power Vcc of the power supply and a gate all high signal All_h may be maintained logic high during a normal operation NOR of the display panel. Scan signals Gout #1 to Gout #m output from the shift register may sequentially generate logic high.

During a discharging operation DSC of the display panel, the power Vcc of the power supply and the gate all high signal All_h may switch from the logic high state to a logic low state. The scan signals Gout #1 to Gout #m output from the shift register may rise to logic high at the same time. The scan signals Gout #1 to Gout #m may simultaneously switch to logic high in response to the gate all high signal All_h switched to logic low.

The scan signals Gout #1 to Gout #m may be generated based on the gate low voltage Vg1 and the gate high voltage Vgh. For the scan signals Gout #1 to Gout #m, the gate high voltage Vgh may be set to a relatively high voltage level in order to enhance the turn-on property of thin film transistors included in the sub-pixels.

Since the scan signals Gout #1 to Gout #m sequentially generate logic high and then sequentially switch to logic low during the normal operation NOR of the display panel, there is almost no possibility of occurrence of inrush current.

However, because the scan signals Gout #1 to Gout #m simultaneously switch to logic high and then are maintained logic high for a certain period of time (during a specific time period over which the discharging may be completed) during the discharging operation DSC of the display panel, the inrush current is highly likely to occur. There is a high possibility that the gate high voltage Vgh set to a relatively high voltage level incurs the inrush current.

In this situation, when the wiring width of the gate high voltage line VGH is narrow or there is a design restriction inevitably leading to a narrow wiring width in a specific area of the gate high voltage line VGH, the inrush current generated during the discharging operation may damage a contact portion (a portion in which the contact resistance R_CONTACT exists).

This is because for a narrow wiring width, critical current is lowered, causing vulnerability to the inrush current (based on the Fuse theory, and the critical current has a proportional relationship with the cross-sectional area of the wiring). The inrush current may damage the vulnerable part of a wiring and cause burnt in a worse case.

According to the present invention, however, since the display panel performs a discharging operation based on the second gate high voltage Vgh2 lower than the gate high voltage Vgh as illustrated in FIG. 7, the above-described problem may be prevented. That is, the logic high level of the scan signals Gout #1 to Gout #m may drop to the level of the second gate high voltage Vgh2 lower than the gate high voltage Vgh during the discharging operation DSC of the display panel.

According to the above description, the peak current may be lowered by using the second gate high voltage Vgh2 lower than the gate high voltage Vgh during the discharging operation of the display panel in the first embodiment of the present invention. Further, according to the first embodiment of the present invention, the use of the second gate high voltage Vgh2 lower than the gate high voltage Vgh may decrease the possibility of occurrence of the inrush current. Further, according to the first embodiment of the present invention, inrush current-caused damage to the vulnerable part or occurrence of a burnt may be prevented.

Figure 13:
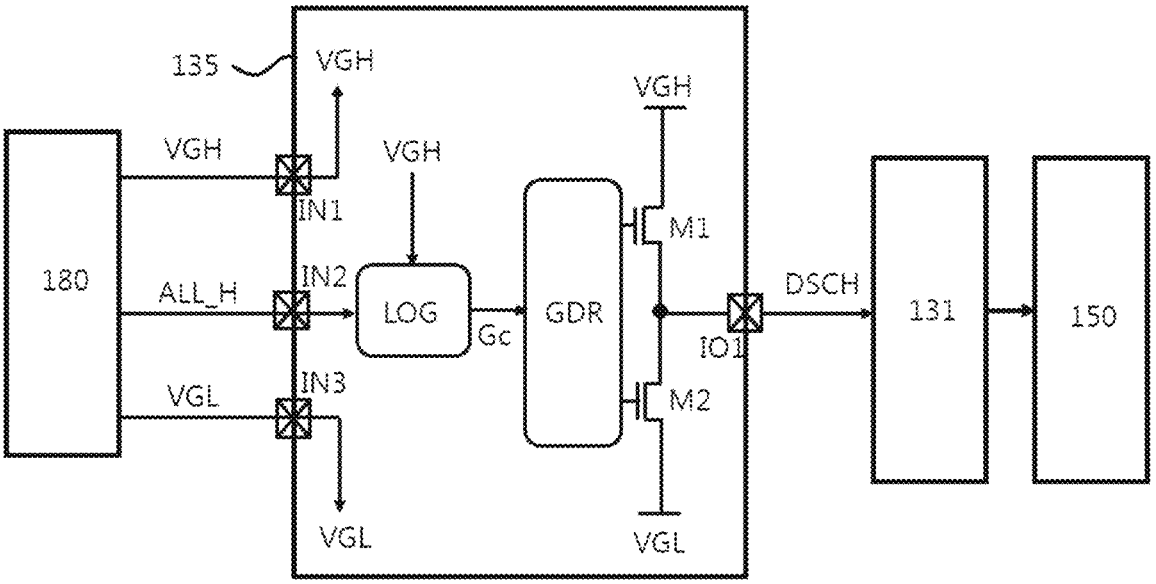
FIG. 13 is a diagram illustrating a circuit part for discharging a display panel in a light emitting display device according to a second embodiment of the present invention.
Figure 14:
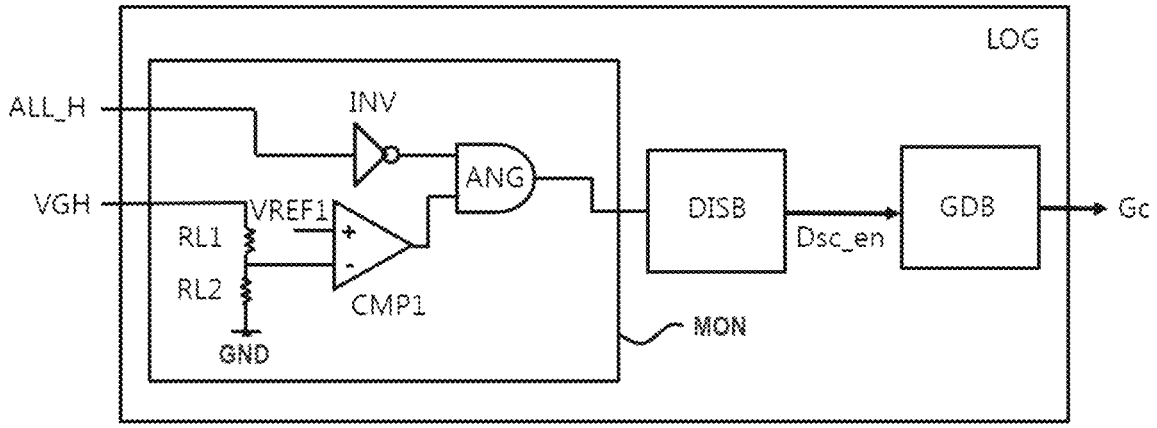
FIG. 14 is a detailed diagram illustrating the configuration of a logic circuit illustrated in FIG. 13, and FIGS. 15 and 16 are diagrams illustrating an operation of the logic circuit illustrated in FIG. 14.
Figure 15:
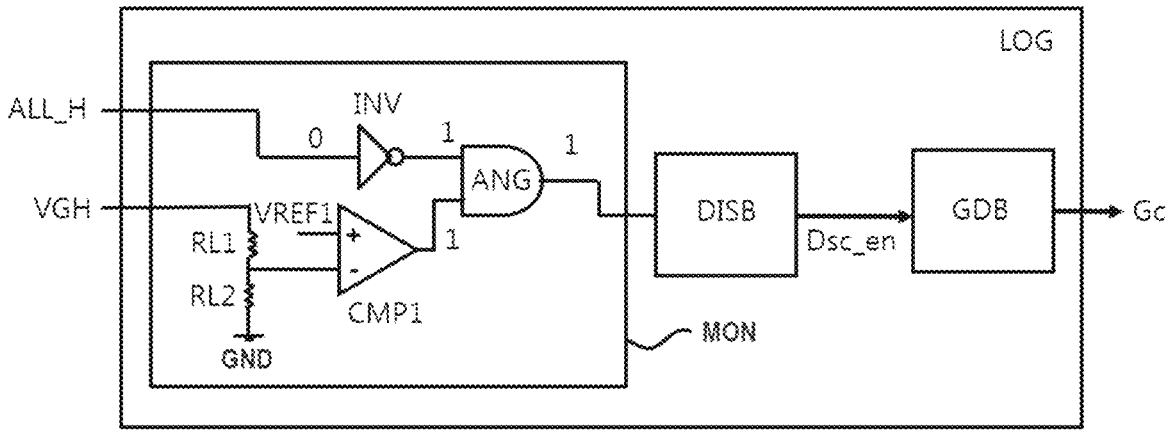
Figure 16:
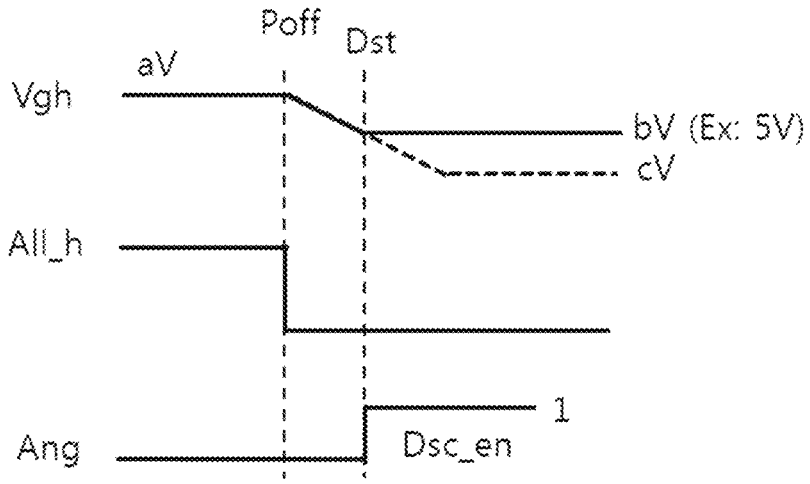

FIG. 13 is a diagram illustrating a circuit part for discharging a display panel in a light emitting display device according to a second embodiment of the present invention, FIG. 14 is a detailed diagram illustrating the configuration of a logic circuit illustrated in FIG. 13, and FIGS. 15 and 16 are diagrams illustrating an operation of the logic circuit illustrated in FIG. 14.

Referring to FIG. 13, the level shifter 135 may include first to third input terminals IN1 to IN3, a first output terminal IO1, a logic controller LOG, a driving controller GDR, a first transistor M1, and a second transistor M2. While the first transistor M1 and the second transistor M2 are shown as an N type by way of example, they may be implemented as a P type.

The first to third input terminals IN1 to IN3 of the level shifter 135 may be connected to the gate high voltage line VGH, the all high line ALL_H, and the gate low voltage line VGL, respectively. The first output terminal IO1 may be connected to the discharge signal line DSCH.

The logic controller LOG may have an input terminal connected to the second input terminal IN2 and an output terminal connected to the driving controller GDR. The logic controller LOG may function to control logic controller LOG included in the level shifter 135. The logic controller LOG may output a driving control signal Gc that controls the driving controller GDR based on the gate all high signal applied through the all high line ALL_H and the gate high voltage applied through the gate high voltage line VGH. A part related to the logic controller LOG will be described below in greater detail.

The driving controller GDR may control the first transistor M1 and the second transistor M2 based on the driving control signal Gc received from the logic controller LOG, and control a signal to be output through the first output terminal IO1 of the level shifter 135. For this purpose, output terminals of the driving controller GDR may be connected to gate electrodes (control electrodes) of the first transistor M1 and the second transistor M2, respectively.

The first transistor M1 and the second transistor M2 may perform a switching operation of turning on or off under the control of the driving controller GDR. The first transistor M1 and the second transistor M2 may output various signals based on the gate high voltage and the gate low voltage applied through the gate high voltage line VGH and the gate low voltage line VGL, respectively. For example, a circuit may be configured for the first transistor M1 and the second transistor M2 as the illustrated in FIG. 13. The first transistor M1 and the second transistor M2 may output signals such as a clock signal, a start signal, and a discharge signal based on the gate high voltage and the gate low voltage. In the present invention, the description and illustration are made, focusing on the circuit for outputting the discharge signal.

Referring to FIG. 14, the logic controller LOG may include a voltage monitor MON, a discharge controller DISB, and a signal generator GDB. The voltage monitor MON may output a result signal based on the gate all high signal and the gate high voltage. The discharge controller DISB may output a discharge enable signal Dsc_en based on the result signal received from the voltage monitor MON. The signal generator GDB may change or control the driving control signal Gc in response to the logic state of the discharge enable signal Dsc_en received from the discharge controller DISB.

The voltage monitor MON may include a first monitoring resistor RL1, a second monitoring resistor RL2, a first comparator CMP1, an inverter INV, and an AND gate ANG.

The first monitoring resistor RL1 may have one end which is connected to the gate high voltage line VGH and the other end which is connected to an inverting terminal (−) of the first comparator CMP1 and one end of the second monitoring resistor RL2. The second monitoring resistor RL2 may have the one end which is connected to the other end of the first monitoring resistor RL1 and the inverting terminal (−) of the first comparator CMP1 and the other end which is connected to a ground line GND.

The first comparator CMP1 may have the inverting terminal (−) connected between the other end of the first monitoring resistor RL1 and the one end of the second monitoring resistor RL2, a non-inverting terminal (+) connected to a first reference voltage line VREF1, and an output terminal connected to a second input terminal of the AND gate ANG.

The inverter INV may have an input terminal connected to the all high signal line ALL_H and an output terminal connected to a first input terminal of the AND gate ANG. The AND gate ANG may have the first input terminal connected to the output terminal of the inverter INV, the second input terminal connected to the output terminal of the first comparator CMP1, and an output terminal connected to an input terminal of the discharge controller DISB.

Referring to FIGS. 15 and 16, when input conditions applied through the non-inverting terminal (+) and the inverting terminal (−) are similar or the same, the first comparator CMP1 may output 1 as a result value. For example, when the gate high voltage is 5V, the first comparator CMP1 may output 1. Since the inverter INV inverts an input 0 to 1 and thus outputs 1, even though the gate all high signal All_h is switched to logic low, the inverter INV may invert the logic low level and thus output 1. Since values input to both terminals of the AND gate ANG are all 1s, the AND gate ANG may output 1 as a result signal.

Accordingly, when the gate high voltage is dropped to 5V, that is, reaches the discharge start period Dst during monitoring of the gate high voltage, the voltage monitor MON may output a result signal that controls the discharge controller DISB to output the discharge enable signal Dsc_en. The signal generator GDB may change or control the driving control signal Gc in response to the logic high state of the discharge enable signal Dsc_en.

According to the above description, when the gate high voltage is dropped to an internally set voltage level during monitoring of the gate high voltage, the discharge signal for discharging the display panel may be output in the second embodiment of the present invention. The second embodiment of the present invention reveals that the first embodiment may be achieved by modifying the logic controller LOG in the level shifter 135.

Figure 17:
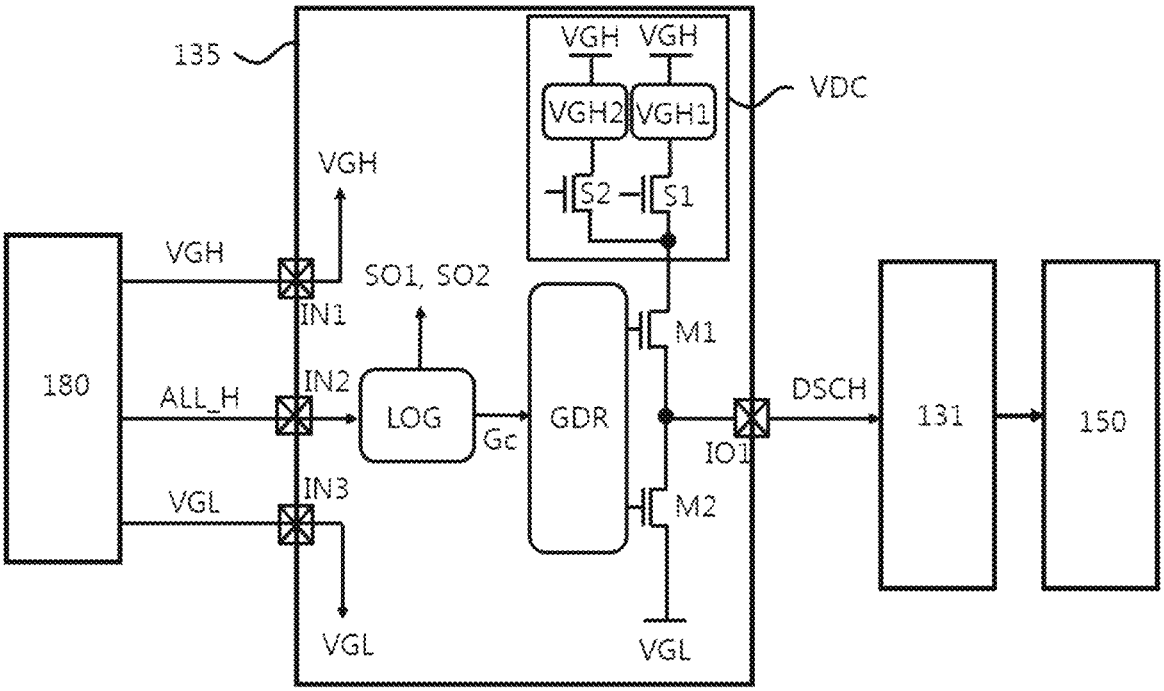
FIG. 17 is a diagram illustrating a circuit part for discharging a display panel in a light emitting display device according to a third embodiment of the present invention.
Figure 18:
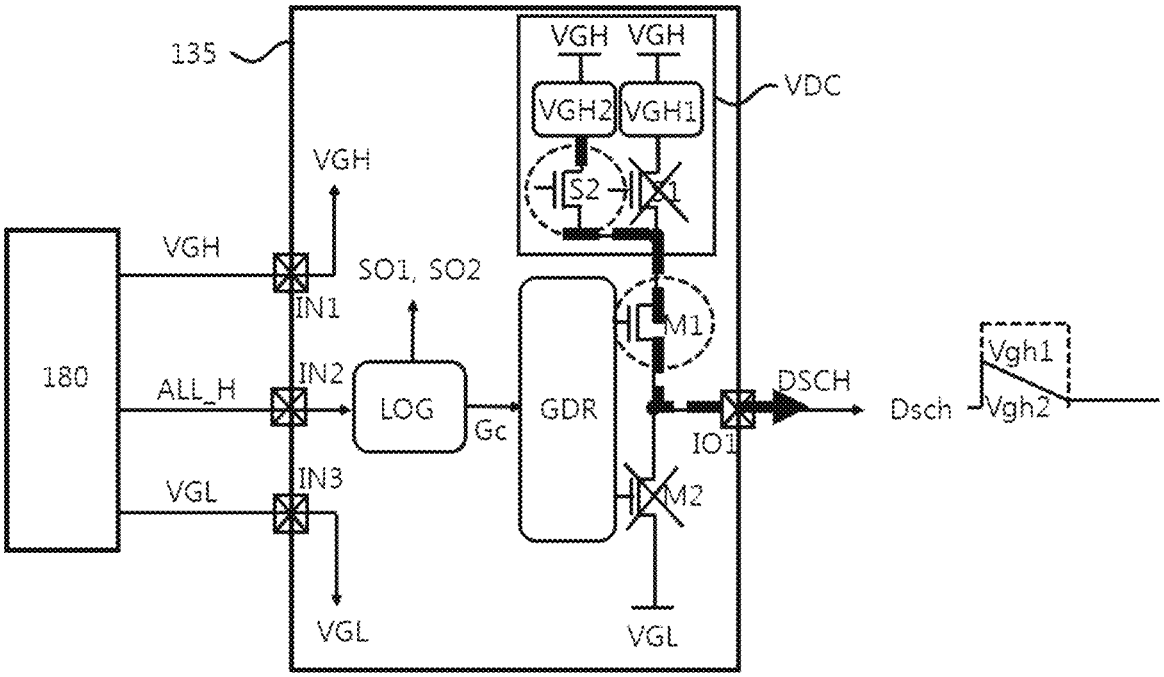
FIGS. 18, 19 and 20 are diagrams illustrating an operation of a voltage controller illustrated in FIG. 17.
Figure 19:
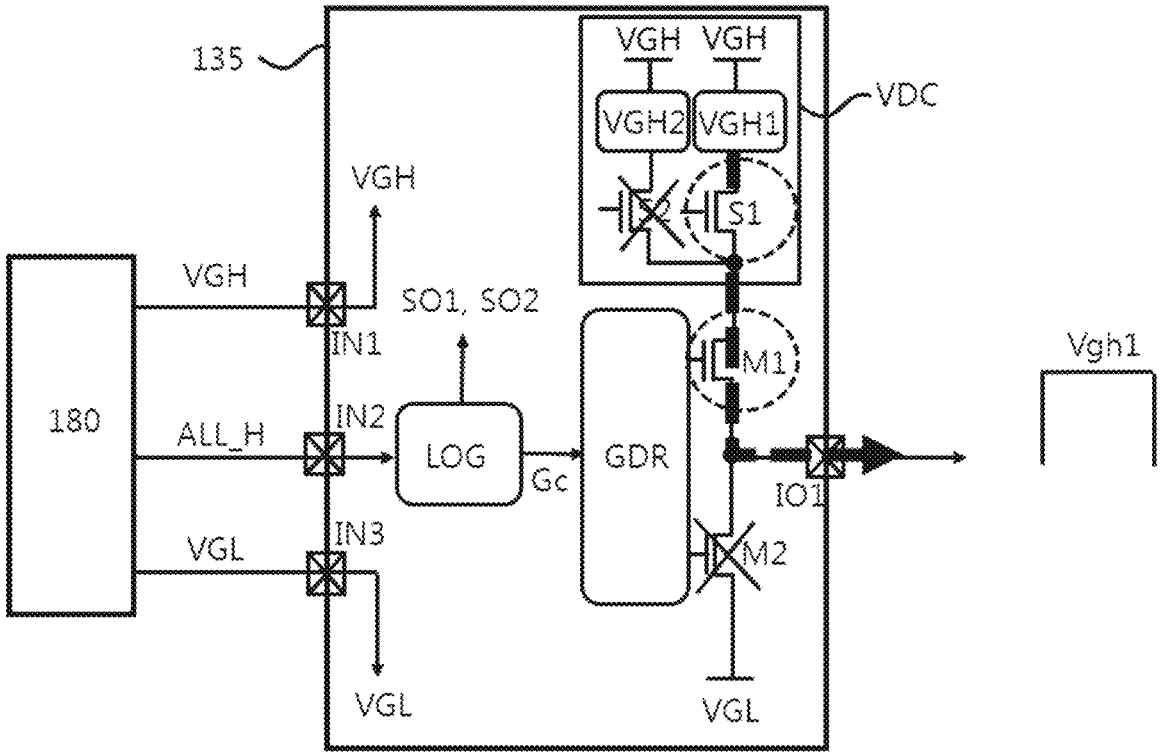
Figure 20:
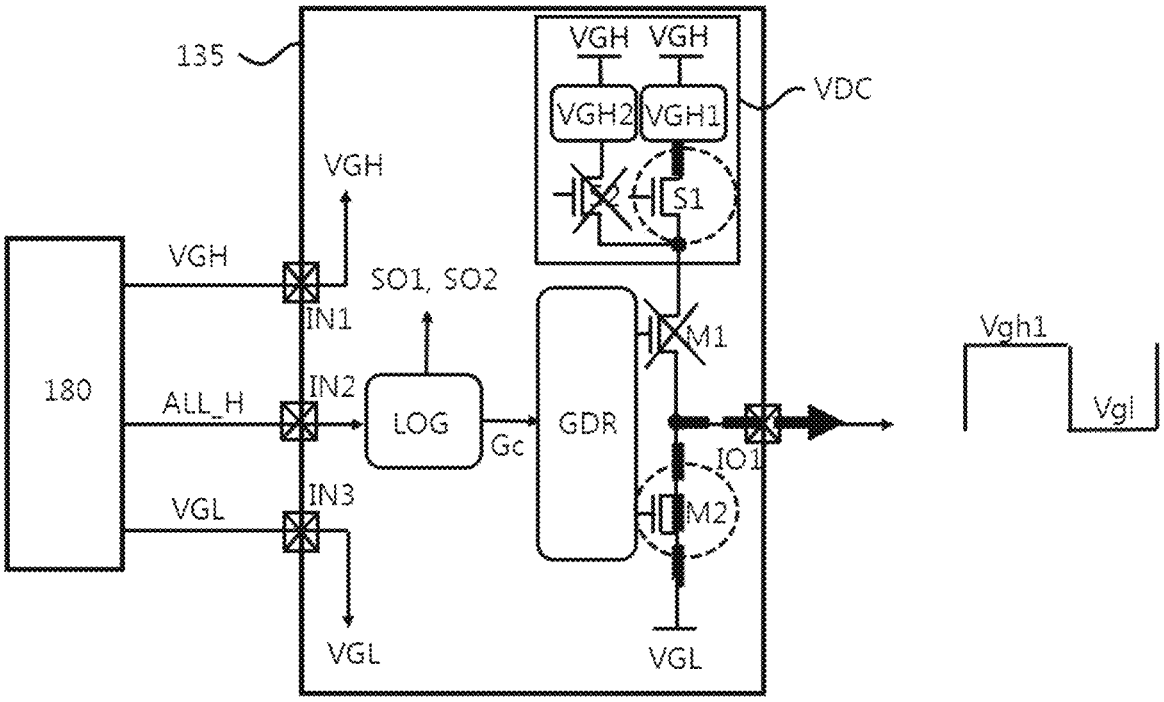

FIG. 17 is a diagram illustrating a circuit part for discharging a display panel in a light emitting display device according to a third embodiment of the present invention, and FIGS. 18, 19 and 20 are diagrams illustrating an operation of a voltage controller illustrated in FIG. 17.

Referring to FIG. 17, the level shifter 135 may include the first to third input terminals IN1 to IN3, the first output terminal IO1, the logic controller LOG, the driving controller GDR, a voltage controller VDC, the first transistor M1, and the second transistor M2.

Compared to the second embodiment, the level shifter 135 according to the third embodiment of the present invention further includes the voltage controller VDC. Therefore, the operation condition of the logic controller LOG is changed, which will be described in detail. Components which are not described below are identical to their counterparts in the second embodiment and thus, the description of the second embodiment is referred to.

The logic controller LOG may include control terminals that output switch control signals for controlling a first switch S1 and a second switch S2 included in the voltage controller VDC. The logic controller LOG may output a first switch control signal through a first control terminal SO1 and may output a second switch control signal through a second control terminal SO2.

The voltage controller VDC may include the first switch S1, the second switch S2, a first gate high voltage converter VGH1, and a second gate high voltage converter VGH2. While the first switch S1 and the second switch S2 are shown as an N type by way of example, they may be implemented as a P type.

The first switch S1 may have a gate electrode connected to the first control terminal SO1 of the logic controller LOG, a first electrode connected to an output terminal of the first gate high voltage converter VGH1, and a second electrode connected to a first electrode of the first transistor M1. The first switch S1 may be turned on or off in response to the first switch control signal received through the first control terminal SO1 of the logic controller LOG.

The first gate high voltage converter VGH1 may have an input terminal connected to the gate high voltage line VGH, and the output terminal connected to the first electrode of the first switch S1. The first gate high voltage converter VGH1 may raise the level of an input gate high voltage and output the gate high voltage at the increased level as a first gate high voltage or output the input gate high voltage as it is (that is, the gate high voltage as it is). When the gate high voltage is at a level enough to turn the thin film transistors of the display panel, the gate high voltage may be output as it is input.

The second switch S2 may have a gate electrode connected to the second control terminal SO2 of the logic controller LOG, a first electrode connected to an output terminal of the second gate high voltage converter VGH2, and a second electrode connected to the first electrode of the first transistor M1. The second switch S2 may be turned on or off in response to the second switch control signal received through the second control terminal SO2 of the logic controller LOG.

The second gate high voltage converter VGH2 may have an input terminal connected to the gate high voltage line VGH and the output terminal connected to the first electrode of the second switch S2. The second gate high voltage converter VGH2 may lower the level of an input gate high voltage and output the gate high voltage at the decreased level as a second gate high voltage.

Referring to FIG. 18, the logic controller LOG may output a logic low first switch control signal through the first control terminal SO1 and a logic high second switch control signal through the second control terminal SO2 during discharging of the display panel. As a result, the second switch S2 may be turned on, while the first switch S1 may be turned off.

As the second switch S2 is turned on, the gate high voltage Vgh applied to the voltage controller VDC may be lowered to the second gate high voltage Vgh2. The second gate high voltage Vgh2 may be output through the turned-on first transistor M1. Accordingly, when the display panel is discharged, the level shifter 135 may configure and output the discharge control signal Dsch based on the second gate high voltage Vgh2 lower than the first gate high voltage Vgh1.

Referring to FIGS. 19 and 20, during a normal operation of the display panel, the logic controller LOG may output a logic high first switch control signal through the first control terminal SO1, and a logic low second switch control signal through the second control terminal SO2. As a result, the first switch S1 may be turned on, whereas the second switch S2 may be turned off.

As the first switch S1 is turned on, the gate high voltage Vgh applied to the voltage controller VDC may be raised to the first gate high voltage Vgh1 and output or may be output as it is. When the first transistor M1 is turned on, the first transistor M1 may form logic high with the first gate high voltage Vgh1. When the second transistor M2 is turned on, the second transistor M2 may form logic low with the gate low voltage. Accordingly, the level shifter 135 may configure and output a signal based on the first gate high voltage Vgh1 during the normal operation of the display panel.

According to the above description, in the third embodiment of the present invention, a discharge signal that discharges the display panel based on the second gate high voltage lower than the first gate high voltage (or the gate high voltage) may be output. The third embodiment of the present invention reveals that the first embodiment may be achieved by adding the voltage controller VDC inside the level shifter 135.

Figure 21:
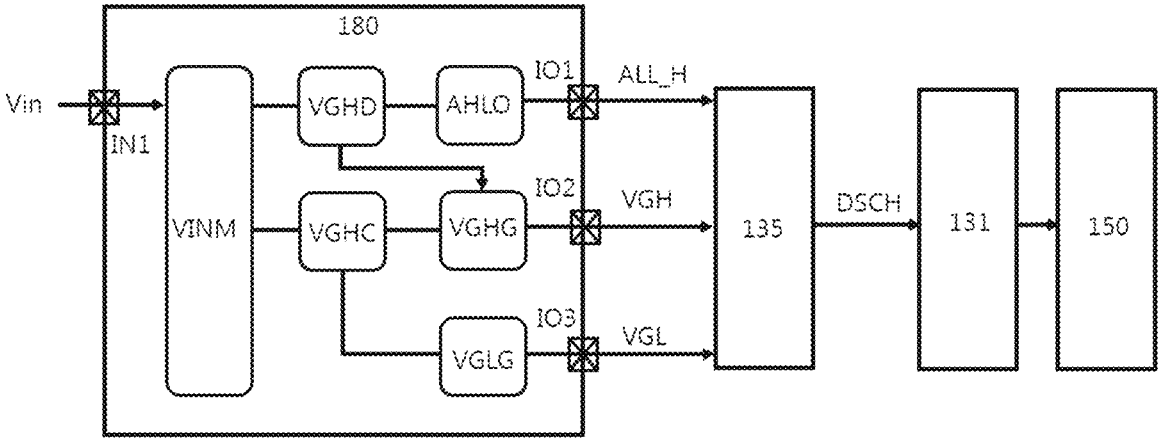
FIG. 21 is a diagram illustrating a circuit part for discharging a display panel in a light emitting display device according to a fourth embodiment of the present invention.
Figure 22:
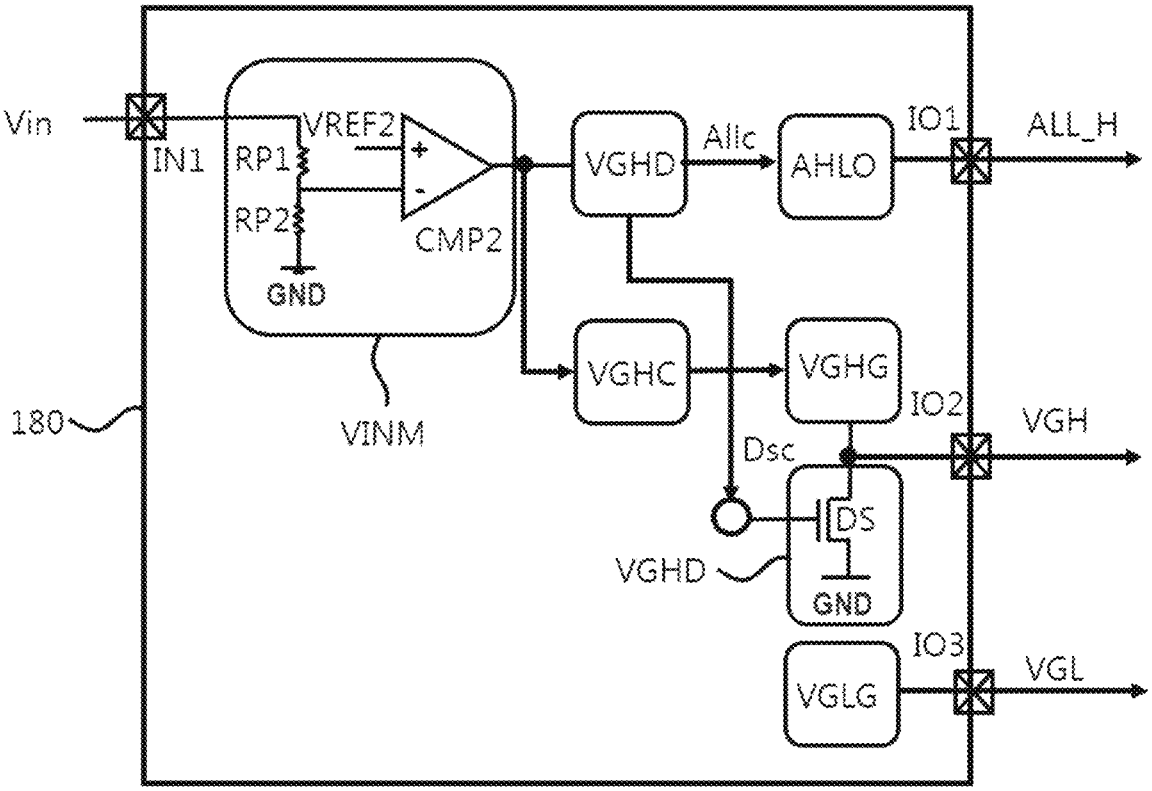
FIG. 22 is a detailed diagram illustrating a part of the circuits illustrated in FIG. 21.
Figure 23:
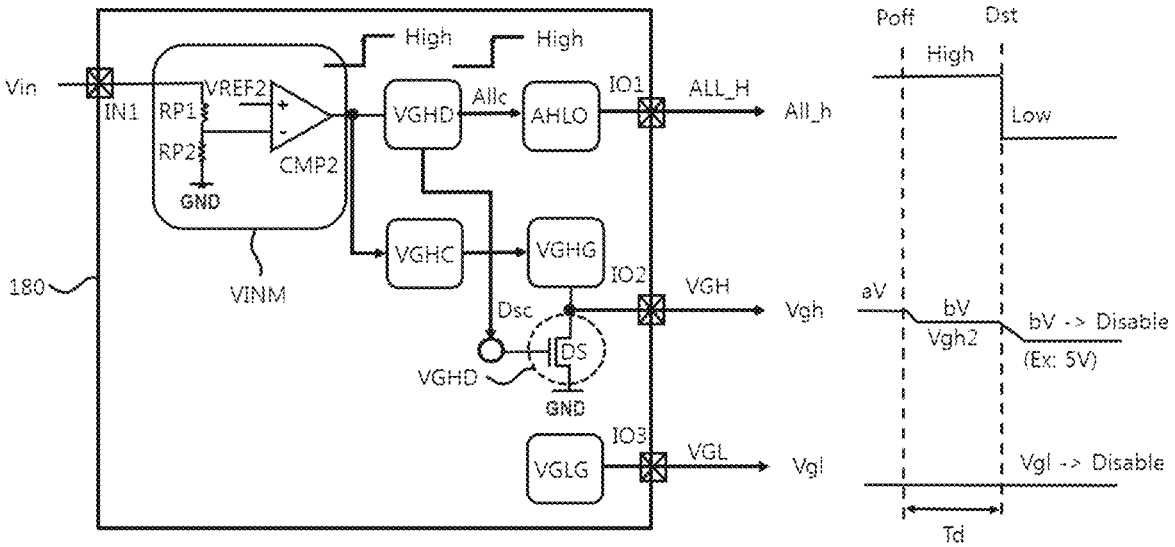
FIG. 23 is a diagram illustrating operations of the circuits illustrated in FIG. 22.

FIG. 21 is a diagram illustrating a circuit part for discharging a display panel in a light emitting display device according to a fourth embodiment of the present invention, FIG. 22 is a detailed diagram illustrating a part of the circuits illustrated in FIG. 21, and FIG. 23 is a diagram illustrating operations of the circuits illustrated in FIG. 22.

Referring to FIG. 21, the power supply 180 may include a first input terminal IN1, first to third output terminals IO1 to IO3, a voltage detector VINM, a gate voltage converter VGHD, a gate all high generator AHLO, a gate voltage controller VGHC, a gate high voltage generator VGHG, and a gate low voltage generator VGLG. While the gate voltage converter VGHD and the gate voltage controller VGHC are separated for convenience of description, they may be integrated into one unit.

The voltage detector VINM may serve to detect whether an input voltage Vin has been changed. When the input voltage Vin is dropped, the gate voltage converter VGHD may function to change the gate high voltage or attempt discharging to lower the gate high voltage generated from the gate high voltage generator VGHG to the level of the second gate high voltage which is lower than the gate high voltage.

The gate all high generator AHLO may generate the gate all high signal and change the logic state of the gate all high signal output through the first output terminal IO1 in response to the state of the input voltage Vin. The gate voltage controller VGHC may function to control the gate high voltage generator VGHG and the gate low voltage generator VGLG to generate or stop the gate high voltage and the gate low voltage, respectively.

The gate high voltage generator VGHG may serve to generate the gate high voltage and output the gate high voltage through the second output terminal IO2. The gate low voltage generator VGLG may serve to generate the gate low voltage and output the gate low voltage through the third output terminal IO3.

Referring to FIG. 22, the voltage detector VINM may include a first resistor RP1, a second resistor RP2, and a second comparator CMP2. When the input voltage Vin is dropped to an internally set voltage level, the voltage detector VINM may output a result signal.

The first resistor RP1 may have one end which is connected to the first input terminal IN1 and the other end which is connected to an inverting terminal (−) of the second comparator CMP2 and one end of the second resistor RP2. The second resistor RP2 may have the one end which is connected to the other end of the first resistor RP1 and the inverting terminal (−) of the second comparator CMP2, and the other end which is connected to the ground line GND.

The second comparator CMP2 may have the inverting terminal (−) connected between the other end of the first resistor RP1 and the one end of the second resistor RP2, a non-inverting terminal (+) connected to a second reference voltage line VREF2, and an output terminal connected to an input terminal of the gate voltage converter VGHD.

The gate voltage converter VGHD may further include a voltage converter DS. The gate voltage converter VGHD may output a first control signal Allc that controls the gate all high generator AHLO and a second control signal Dsc that controls the voltage converter DS connected to the gate high voltage generator VGHG based on the result signal received from the voltage detector VINM.

The voltage converter DS may have a gate electrode (control electrode) connected to a second output terminal of the gate voltage converter VGHD, a first electrode connected to an output terminal of the gate high voltage generator VGHG and the second output terminal IO2 of the power supply 180, and a second electrode connected to the ground line GND. Although the voltage converter DS has been simplified as a switch, the present invention is not limited thereto.

Referring to FIG. 23, the voltage detector VINM may determine whether the power supply 180 (or the light emitting display device) has been powered off based on a change in the input voltage Vin. Accordingly, when the input voltage Vin is dropped to 1.8V, the voltage detector VINM may output logic high (or 1) as a result signal.

The gate voltage converter VGHD may output a logic high first control signal Allc in synchronization with a rising edge of logic high output from the voltage detector VINM. The gate all high generator AHLO which has received the logic high first control signal Allc may switch the gate all high signal All_h from logic high to logic low.

By way of example, the gate all high signal All_h has been described as switching to logic low after the delay time Td from the turn-off time Poff of the power supply 180. However, as in the first embodiment, the gate all high signal All_h may switch to logic low in synchronization with the power-off time Poff of the power supply 180.

The gate voltage converter VGHD may output a logic high second control signal Dsc in synchronization with a rising edge of logic high output from the voltage detector VINM. The voltage converter DS which has received the logic high second control signal Dsc switches the gate high voltage Vgh generated from the gate high voltage generator VGHG to the level of the second gate high voltage Vgh2 lower than that of the gate high voltage Vgh. As a result, the gate high voltage Vgh output from the power supply 180 may be dropped to bV (e.g., 5V) lower than aV.

As described above, during the normal operation of the display panel, the power supply 180 may output the logic high gate all high signal All_h through the first output terminal IO1, the gate high voltage Vgh at the level of aV through the second output terminal IO2, and the gate low voltage Vg1 through the third output terminal IO3.

Further, during the discharging operation of the display panel, when the discharge start period Dst follows a time during which the input voltage Vin is dropped to 1.8V, that is, the time delay Td, the power supply 180 may output the logic low gate all high signal All_h through the first output terminal IO1, the second gate high voltage Vgh2 at or below the level of bV through the second output terminal IO2, and the gate low voltage Vg1 through the third output terminal IO3.

According to the above description, the discharge signal that discharges the display panel based on the second gate high voltage Vgh2 lower than the gate high voltage Vgh may be output in the fourth embodiment of the present invention. The fourth embodiment of the present invention reveals that the first embodiment may be achieved by adding the voltage detector VINM and the gate voltage converter VGHD in the power supply 180.

Figure 24:
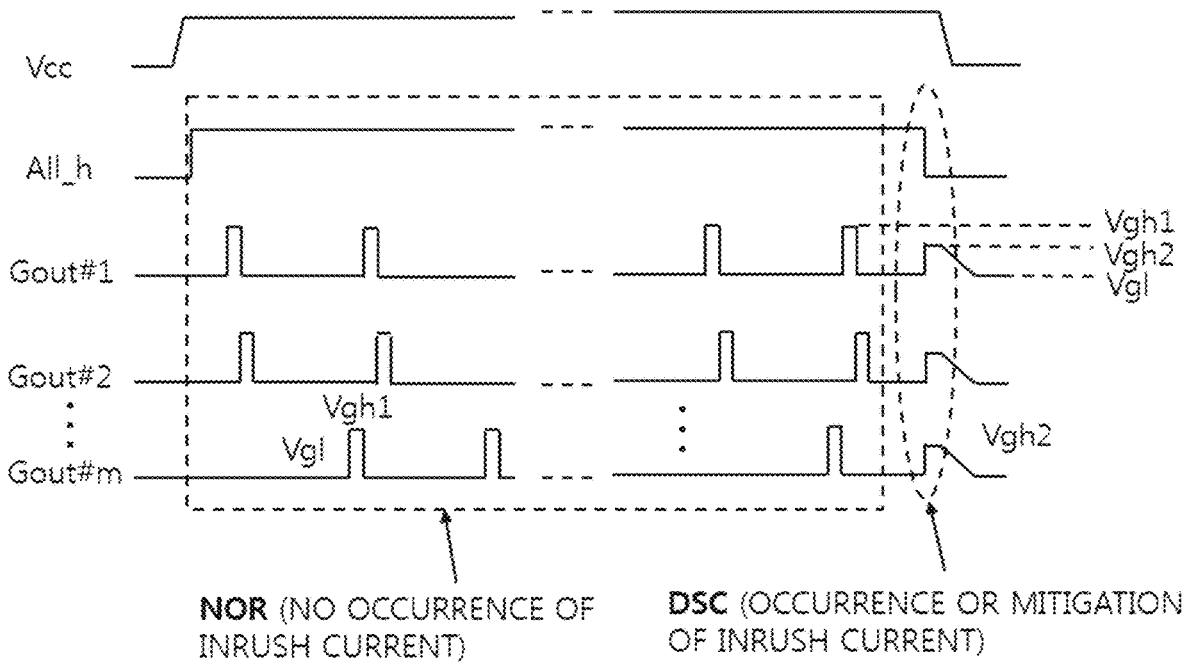
FIG. 24 is a diagram illustrating level changes in scan signals during discharging of a display panel.

FIG. 24 is a diagram illustrating changes in the levels of scan signals during discharging of a display panel.

Referring to FIG. 24, according to embodiments of the present invention, the scan driver may simultaneously output scan signals Gout #1 to Gout #m that prevent generation of inrush current or mitigating the inrush current. The scan signals Gout #1 to Gout #m may be based on the second gate high voltage Vgh2 lower than the first gate high voltage Vgh1. While FIG. 24 illustrates simultaneous output of logic-high scan signals Gout #1 to Gout #m by way of example, logic low scan signals Gout #1 to Gout #m may also be output at the same time according to the type of thin film transistors on the display panel. That is, the scan signals Gout #1 to Gout #m may be configured to turn on the thin film transistors of the display panel and may be output simultaneously.

In the present invention, the first embodiment and the second, third, and fourth embodiments which are circuit configurations to achieve the first embodiment have been described as separate embodiments. However, that two or more of the embodiments may be partially combined in order to achieve precise control of circuits or voltages, implementation of circuits, or better effects.

As is apparent from the above description, the present invention has an effect of reducing the possibility of occurrence of inrush current through reduction of peak current and preventing damage to a vulnerable part or occurrence of a burnt which might otherwise be caused by the inrush current, during a discharging operation of a display panel. Further, the possibility of generating peak current may be reduced and a safe discharging sequence may be provided, during the discharging operation of the display panel.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A display device comprising:

a display panel displaying an image;

a scan driver configured to apply scan signals to the display panel; and a power supply configured to apply a first gate high voltage and a gate low voltage to the scan driver, wherein the scan driver discharges the display panel based on a second gate high voltage lower than the first gate high voltage during a discharging operation of the display panel, and wherein the second gate high voltage has a level between the first gate high voltage and a ground voltage, wherein the scan driver comprises a logic controller configured to monitor the first gate high voltage and a gate all high signal for simultaneously switching the states of the scan signals and, when the first gate high voltage is dropped to an internally set voltage level, control output of the first gate high voltage based on a discharge enable signal that enables discharging of the display panel, wherein the logic controller comprising a voltage monitor, and wherein the voltage monitor comprises:

a first monitoring resistor having one end connected to a gate high voltage line through which the first gate high voltage is transmitted;

a second monitoring resistor having one end connected to the other end of the first monitoring resistor and the other end connected to a ground line;

a first comparator having an inverting terminal connected between the other end of the first monitoring resistor and the one end of the second monitoring resistor, and a non-inverting terminal connected to a first reference voltage line;

an inverter having an input terminal connected to an all high signal line through which the gate all high signal is transmitted; and an AND gate having a first input terminal connected to an output terminal of the inverter, a second input terminal connected to an output terminal of the first comparator, and an output terminal connected to an input terminal of a discharge controller configured to output the discharging enable signal.

2. The display device according to claim 1, wherein when the power supply is powered off, the display panel is discharged based on the second gate high voltage after a delay time.

3. The display device according to claim 1, wherein the scan driver comprises:

a voltage controller configured to output the second gate high voltage during the discharging operation of the display panel; and the logic controller configured to control the voltage controller.

4. The display device according to claim 3, wherein the voltage controller comprises:

a gate high voltage converter configured to convert the first gate high voltage to the second gate high voltage; and a switch configured to output or not output the second gate high voltage of the gate high voltage converter in response to a switch control signal received from the logic controller.

5. The display device according to claim 1, wherein the power supply comprises a gate voltage converter configured to, convert the first gate high voltage to the second gate high voltage when an input voltage is dropped to the internally set voltage level.

6. The display device according to claim 5, wherein the power supply further comprises a voltage detector configured to detect the input voltage, and wherein the voltage detector comprises:

a first resistor having one end connected to a first input terminal to which the input voltage is applied;

a second resistor having one end connected to the other end of the first resistor and the other end connected to a ground line; and a second comparator having an inverting terminal connected between the first resistor and the second resistor, a non-inverting terminal connected to a second reference voltage line, and an output terminal connected to an input terminal of the gate voltage converter.

7. The display device according to claim 1, wherein the scan driver is configured to simultaneously output scan signals turning on thin film transistors of the display panel based on the second gate high voltage during the discharging operation of the display panel.

8. A method of driving the display device of claim 1, the method comprising:

powering off the display panel;

converting the first gate high voltage to be applied to the display panel to the second gate high voltage lower than the first gate high voltage; and discharging the display panel based on the second gate high voltage, and wherein the second gate high voltage has a level between the first gate high voltage and a ground voltage.

9. The method according to claim 8, wherein the conversion comprises converting the first gate high voltage to the second gate high voltage when an input voltage for driving the display panel is dropped to the internally set voltage level.

10. The method according to claim 8, wherein the discharging comprises turning on thin film transistors of the display panel by simultaneously outputting scan signals based on the second gate high voltage.

* * * * *